US008783038B2

(12) United States Patent
Horikawa et al.

(10) Patent No.: US 8,783,038 B2
(45) Date of Patent: Jul. 22, 2014

(54) GAS TURBINE COMBUSTOR

(75) Inventors: Atsushi Horikawa, Akashi (JP); Hideki Ogata, Kakogawa (JP); Kenta Yamaguchi, Mitaka (JP); Ryusuke Matsuyama, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 1 day.

(21) Appl. No.: 13/575,938

(22) PCT Filed: Nov. 29, 2010

(86) PCT No.: PCT/JP2010/006931
§ 371 (c)(1),
(2), (4) Date: Sep. 13, 2012

(87) PCT Pub. No.: WO2011/092779
PCT Pub. Date: Aug. 4, 2011

(65) Prior Publication Data

US 2013/0036739 A1 Feb. 14, 2013

(30) Foreign Application Priority Data

Jan. 28, 2010 (JP) ..... 2010-016521

(51) Int. Cl.
*F02C 1/00* (2006.01)
*F23R 3/28* (2006.01)
*F23R 3/14* (2006.01)

(52) U.S. Cl.
CPC .... *F23R 3/14* (2013.01); *F23R 3/28* (2013.01)
USPC ..... 60/748

(58) Field of Classification Search
USPC ..... 60/737, 738, 748; 431/354
See application file for complete search history.

(56) References Cited

U.S. PATENT DOCUMENTS 4,180,974 A * 1/1980 Stenger et al. ..... 60/748
4,584,834 A * 4/1986 Koshoffer et al. ..... 60/737
5,623,827 A * 4/1997 Monty ..... 60/748

(Continued)

FOREIGN PATENT DOCUMENTS

JP 2003013746 1/2003
JP 2007139407 6/2007
JP 2008196830 8/2008

OTHER PUBLICATIONS

Yashima, Satoshi, "Technologies for High Performance Turbofan Engine," Defense Technology Journal, vol. 12, No. 8, Aug. 1992, 14 pages.

(Continued)

*Primary Examiner* — Phutthiwat Wongwian
*Assistant Examiner* — Scott Walthour
(74) *Attorney, Agent, or Firm* — Alleman Hall McCoy Russell & Tuttle LLP

(57) ABSTRACT

A gas turbine combustor of the present invention comprises a fuel injector for injecting a fuel toward a combustion chamber; a swirler which takes-in compressed air generated in a compressor and swirls the compressed air, in the vicinity of the fuel injector; a tubular guide member for guiding the compressed air taken-in from the swirler, to the combustion chamber; and a heat shield having a cylindrical portion located outward relative to the guide member; wherein the cylindrical portion has a purge hole; and air is introduced through the purge hole and is supplied to a space formed between the guide member and the cylindrical portion.

5 Claims, 8 Drawing Sheets

PRESENT INVENTION

(56) References Cited

U.S. PATENT DOCUMENTS

| | | | | |
|---|---|---|---|---|
| 5,884,483 | A * | 3/1999 | Munro | 60/739 |
| 5,894,732 | A * | 4/1999 | Kwan | 60/756 |
| 5,956,955 | A * | 9/1999 | Schmid | 60/748 |
| 6,035,645 | A * | 3/2000 | Bensaadi et al. | 60/742 |
| 6,442,940 | B1 * | 9/2002 | Young et al. | 60/748 |
| 2007/0113556 | A1 * | 5/2007 | Biebel et al. | 60/740 |
| 2008/0202122 | A1 * | 8/2008 | Guezengar et al. | 60/722 |
| 2008/0289340 | A1 * | 11/2008 | Oda et al. | 60/737 |

OTHER PUBLICATIONS

ISA Japan, International Search Report of PCT/JP2010/006931, Jan. 11, 2011, WIPO, 1 page.

* cited by examiner

PRESENT INVENTION

PRIOR ART EXAMPLE

GAS TURBINE COMBUSTOR

TECHNICAL FIELD

The present invention relates to a combustor (hereinafter referred to as a gas turbine combustor) in a gas turbine or a jet engine for an aircraft.

BACKGROUND ART

As one type of gas turbine combustor, an annular type combustor shown in FIG. 7 is widely used (see Non-Patent Literature 1). The annular type combustor includes an annular combustion tube 8 defined by an annular outer liner 9, an annular inner liner 10, and a cowling 20 located upstream of the annular outer liner 9 and the annular inner liner 10. The interior of the combustion tube 8 serves as a combustion chamber 11. A support member 21 constituting a portion of the cowling 20 supports a swirler 14 via a heat shield 23. The heat shield 23 protects the support member 21 from heat generated by combustion in the interior of the combustion chamber 11. The swirler 14 is a device which swirls compressed air CA for combustion and supplies it to the combustion chamber 11, to enable stable combustion. A fuel injector 13 for injecting a fuel penetrates the cowling 20 through an opening 20*a* of the cowling 20 and is internally fitted to the swirler 14.

CITATION LISTS

Non-Patent Literature

Non-Patent Literature 1: "Technologies for High Performance Turbofan Engine" written by Satoshi Yashima, Defense Technology Journal, 92.8, Vol. 12, No. 8 (ISSN 0285-0893), P31-40 FIG. 8

SUMMARY OF THE INVENTION

Technical Problem

As shown in FIG. 7, in the above stated gas turbine combustor, there is formed an annular space 39 defined by a rear end wall 25 of the swirler 14, a cylindrical portion 23*b* of the heat shield 23, and a guide member 34. The annular space 39 opens in the combustion chamber 11 at a downstream side. Therefore, in the annular space 39, an air-fuel mixture M containing a fuel becomes stagnant and soot 60 tends to be deposited. If the deposited soot 60 is heated by combustion gas G, a portion of the guide member 34 of the swirler 14 or a portion of the cylindrical portion 23*b* of the heat shield 23 may be damaged.

The present invention is directed to solving the above mentioned problem, and an object of the present invention is to provide a gas turbine combustor in which soot is less likely to be deposited therein.

Solution to Problem

To achieve the above object, a gas turbine combustor of the present invention comprises a fuel injector for injecting a fuel toward a combustion chamber; a swirler which takes in compressed air generated in a compressor and swirls the compressed air in the vicinity of the fuel injector; a tubular guide member for guiding the compressed air taken in from the swirler and an air-fuel mixture of a fuel injected from the fuel injector to the combustion chamber; and a heat shield having a cylindrical portion located outward relative to the guide member; wherein the cylindrical portion has a purge hole; and air is introduced through the purge hole and is supplied to a space formed between the guide member and the cylindrical portion.

In accordance with this configuration, since the air introduced through the purge hole is supplied to the space between the guide member and the cylindrical portion, the fuel, the air-fuel mixture and the flame, which are going to enter the space, can be pushed out. This can effectively prevent soot from being deposited on the guide member.

In the present invention, the gas turbine combustor may preferably further comprise a guide section for guiding the air introduced through the purge hole to a region in an obliquely outward direction toward a downstream side. In accordance with this configuration, since the air flowing into the space between the guide member and the cylindrical portion is guided by the guide section in the obliquely outward direction toward the downstream side, harmful effects which would be caused by the air flowing axially linearly can be lessened.

In the present invention, preferably, the guide section may be a flare provided at a downstream end of the guide member and may have a diameter increasing toward the downstream side. In accordance with this configuration, the air-fuel mixture having flowed through the guide member and the air introduced through the purge hole flow along the flare. This results in a back-flow zone having a proper speed component in a center axis portion. Thus, a good flame stabilizing performance can be ensured. In addition, the air introduced through the purge hole suppresses the air-fuel mixture which has flowed through the guide member from diffusing radially outward in the combustor. This can prevent the fuel in the air-fuel mixture from adhering onto the heat shield and liquid droplets of the fuel from increasing in size. As a result, degradation of combustion performance can be suppressed.

In the present invention, preferably, the air introduced through the purge hole is the compressed air generated in the compressor. The purge hole preferably includes 10 to 30 purge holes formed on a circumference of the cylindrical portion. If the purge holes are less than ten in number, it is difficult to introduce the compressed air into the space between the guide member and the cylindrical portion of the heat shield uniformly in the circumferential direction. Therefore, the flow of the compressed air cannot effectively push out the fuel, the air-fuel mixture, and flame, which are going to enter the space, into the combustion chamber. If the purge holes are greater than thirty in number, deposition of the soot cannot be prevented substantially effectively, and processing work and costs will increase.

In the present invention, preferably, the flare is inclined 40 to 60 degrees with respect to a center axis of the guide member. If the inclination angle is less than 40 degrees, the swirl flow of the compressed air from the swirler cannot be expanded radially sufficiently when it is supplied to the interior of the combustion chamber, which makes it difficult to form a back-flow zone having a sufficient area. On the other hand, if the inclination angle is greater than 60 degrees, the swirl flow of the compressed air from the swirler is separated from the inner surface of the flare, which makes it impossible to form a back-flow zone having a desired area. Therefore, by setting the inclination angle to a value in a range of 40 to 60 degrees, the swirl flow of the compressed air from the swirler can be flowed into the combustion chamber while expanding it up to a suitable angle, and thus, a good back-flow zone can be formed.

Advantageous Effects of the Invention

In accordance with the gas turbine combustor of the present invention, the air introduced through the purge hole pushes out the fuel, the air-fuel mixture and the flame, which then enter the space between the guide member and the cylindrical portion of the heat shield, and, thus, deposition of soot on the guide member can be prevented effectively.

DESCRIPTION OF EMBODIMENTS

Figure 1:
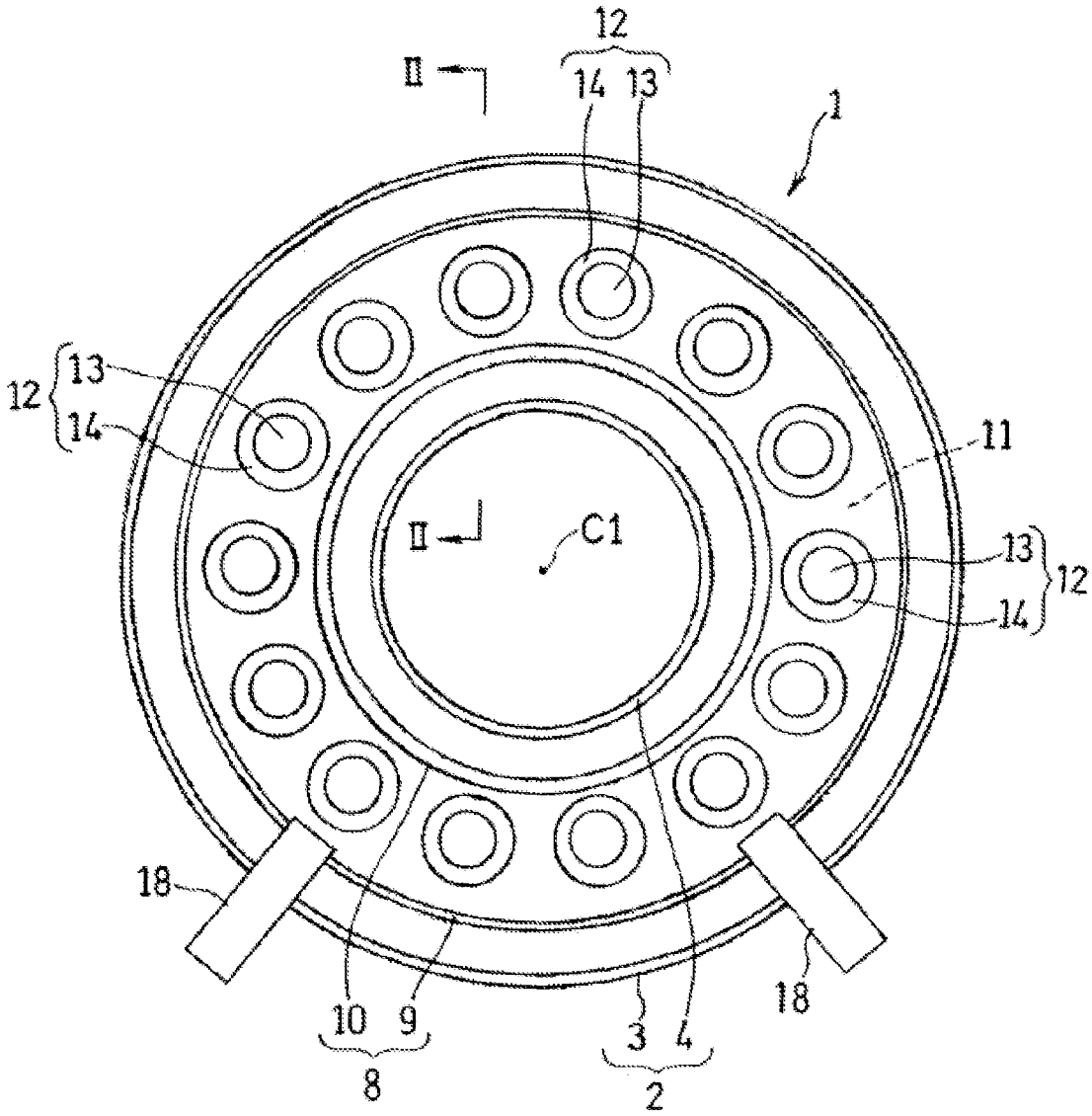
FIG. 1 is a schematic longitudinal sectional view showing a gas turbine combustor according an embodiment of the present invention.

Hereinafter, a preferred embodiment of the present invention will be described in detail with reference to the drawings. FIG. 1 is a schematic longitudinal sectional view in a direction perpendicular to a center axis C1 of a gas turbine combustor 1 according to an embodiment of the present invention. The combustor 1 is configured to mix compressed air supplied from a compressor (not shown) and a fuel to generate an air-fuel mixture and combust the air-fuel mixture in the interior thereof. High-temperature and high-pressure combustion gas G generated by combustion in the combustor 1 is sent to a turbine and actuates the turbine.

In the present embodiment, the combustor 1 is an annular type combustor. As shown in FIG. 1, the combustor 1 is configured in such a manner that an annular housing 2 is defined by an outer casing 3 and an inner casing 4, and an annular combustion tube 8 is defined by an outer liner 9 and an inner liner 10 in the interior of the annular housing 2. An annular inner space is formed in the interior of the combustion tube 8. This inner space serves as a combustion chamber 11. A plurality of (e.g., 14 to 20) fuel injection devices 12 for injecting a fuel to the interior of the combustion chamber 11 are arranged at equal intervals in a circumferential direction thereof. Each fuel injection device 12 includes a fuel injector 13 for injecting the fuel and a main swirler 14 of a radial flow type. The main swirler 14 is configured to swirl compressed air and introduce it into the combustion chamber 11. The main swirler 14 encloses the outer periphery of the fuel injector 13. Two ignition plugs 18 are mounted to the lower portion of the combustor 1.

Figure 2:
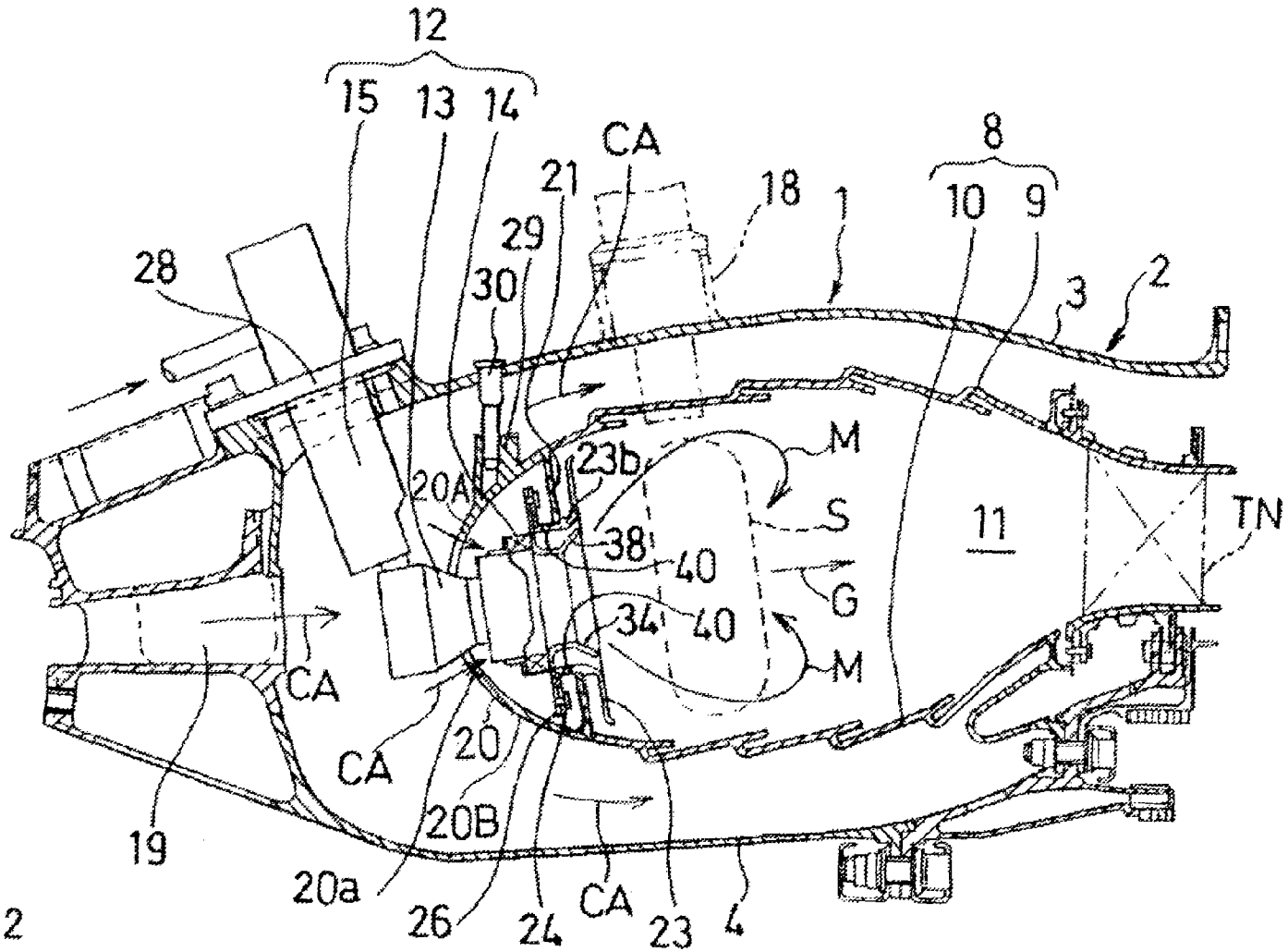
FIG. 2 is an enlarged cross-sectional view taken along II-II of FIG. 1.

As shown in FIG. 2, compressed air CA supplied from a compressor (not shown) is introduced into the annular inner space of the housing 2 via an annular diffuser 19. A cowling 20 includes an annular cowling outer 20A and an annular cowling inner 20B. The outer liner 9 is fastened to the cowling outer 20A, while the inner liner 10 is fastened to the cowling inner 20B. The cowling outer 20A has a retaining tube member 29 integrally formed therewith. A fastening pin 30 is inserted into the retaining tube member 29 from outside of the outer casing 3. The combustion tube 8 is fastened to the outer casing 3 by means of the fastening pin 30.

The downstream end portion of the cowling outer 20A and the downstream end portion of the cowling inner 20B are coupled to each other by means of an annular support member (hereinafter referred to as a dome) 21. The dome 21 is attached with a heat shield 23 for protecting the dome 21 from heat generated by combustion in the interior of the combustion chamber 11.

The fuel injection device 12 includes a stem 15 containing a fuel pipe therein. The fuel injector 13 is attached to the tip end of the stem 15. The main swirler 14 is a radial-flow type swirler which introduces the compressed air CA from radially outward to radially inward. The main swirler 14 is mounted to the hear shield 23 via a retaining plate 24. This mounting structure will be described later. The stem 15 of the fuel injection device 12 is fastened to the outer casing 3 via a mounting plate 28. The fuel injector 13 penetrates the top portion of the cowling 20 through an opening 20*a* formed between the cowling outer 20A and the cowling inner 20B, and is internally fitted to the main swirler 14. An annular gap is formed between the peripheral edge of the opening 20*a* of the cowling 20 and the fuel injector 13. Through the annular gap, the compressed air CA is introduced into the combustion tube 8. A first-stage nozzle TN of the turbine is coupled to the downstream end portion of the combustion tube 8.

Figure 3:
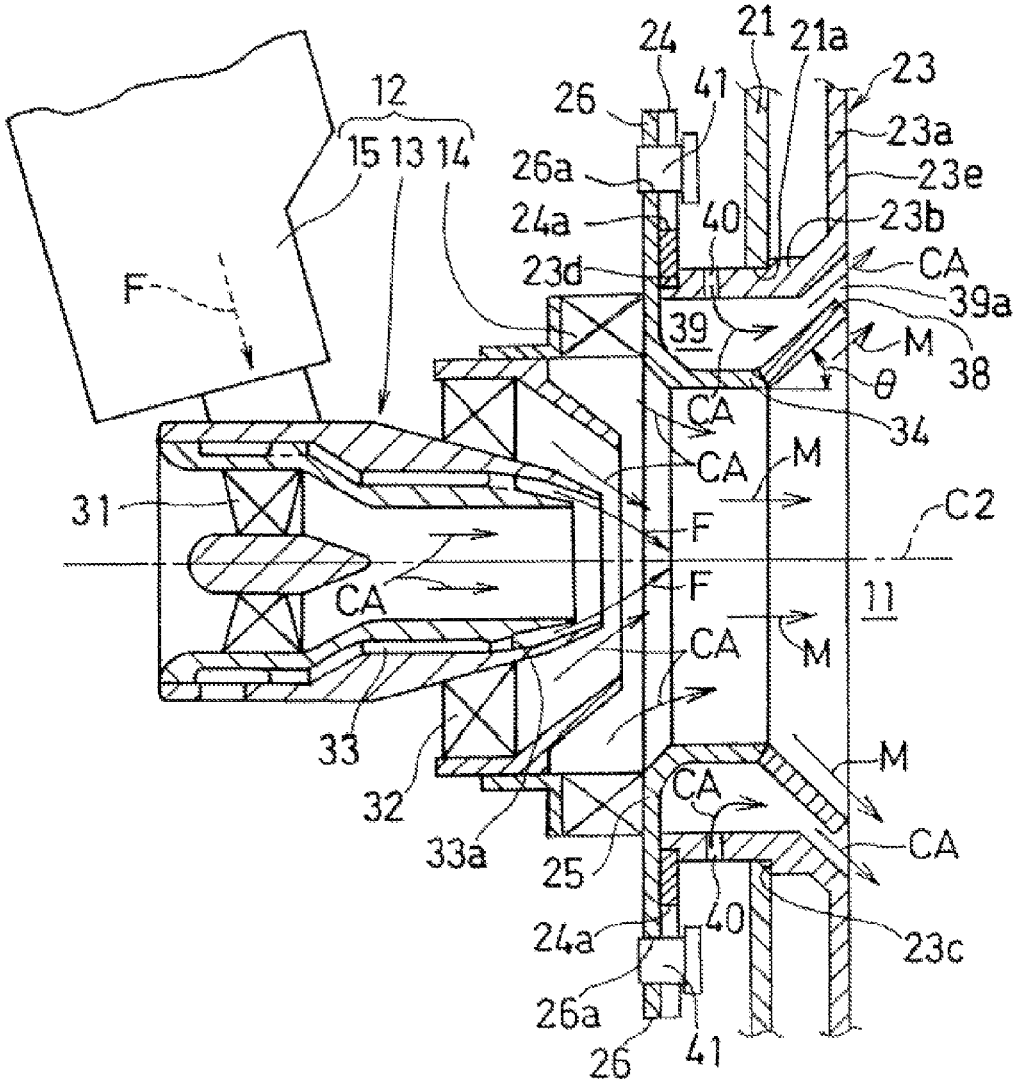
FIG. 3 is an enlarged longitudinal sectional view of major components of FIG. 2.

As shown in FIG. 3, the fuel injector 13 of the fuel injection device 12 includes an axial (axial-flow) inner swirler 31 at a center portion thereof and an axial outer swirler 32 at an outer peripheral side. The swirlers 31 and 32 are laid out around a center axis C2 of the fuel injection device 12. Between air passages of the swirlers 31 and 32, an annular fuel passage 33 is provided to introduce a fuel F supplied from the fuel pipe inside the stem 15 to the interior of the combustion chamber 11. In the vicinity of the tip end of the fuel passage 33, a plurality of fuel injection holes 33*a* are arranged annularly around the center axis C2. The fuel F is injected through the injection holes 33*a* and supplied in a film form from the tip end of the fuel passage 33 to the interior of the combustion chamber 11. The fuel F injected through the injection holes 33*a* is atomized into small particles by the swirl flow of the compressed air CA from the inner and outer swirlers 31 and 32, and is transformed into the air-fuel mixture M, which is supplied to the interior of the combustion chamber 11. Thus, the fuel injection device 12 is of an air blast type.

Figure 4:
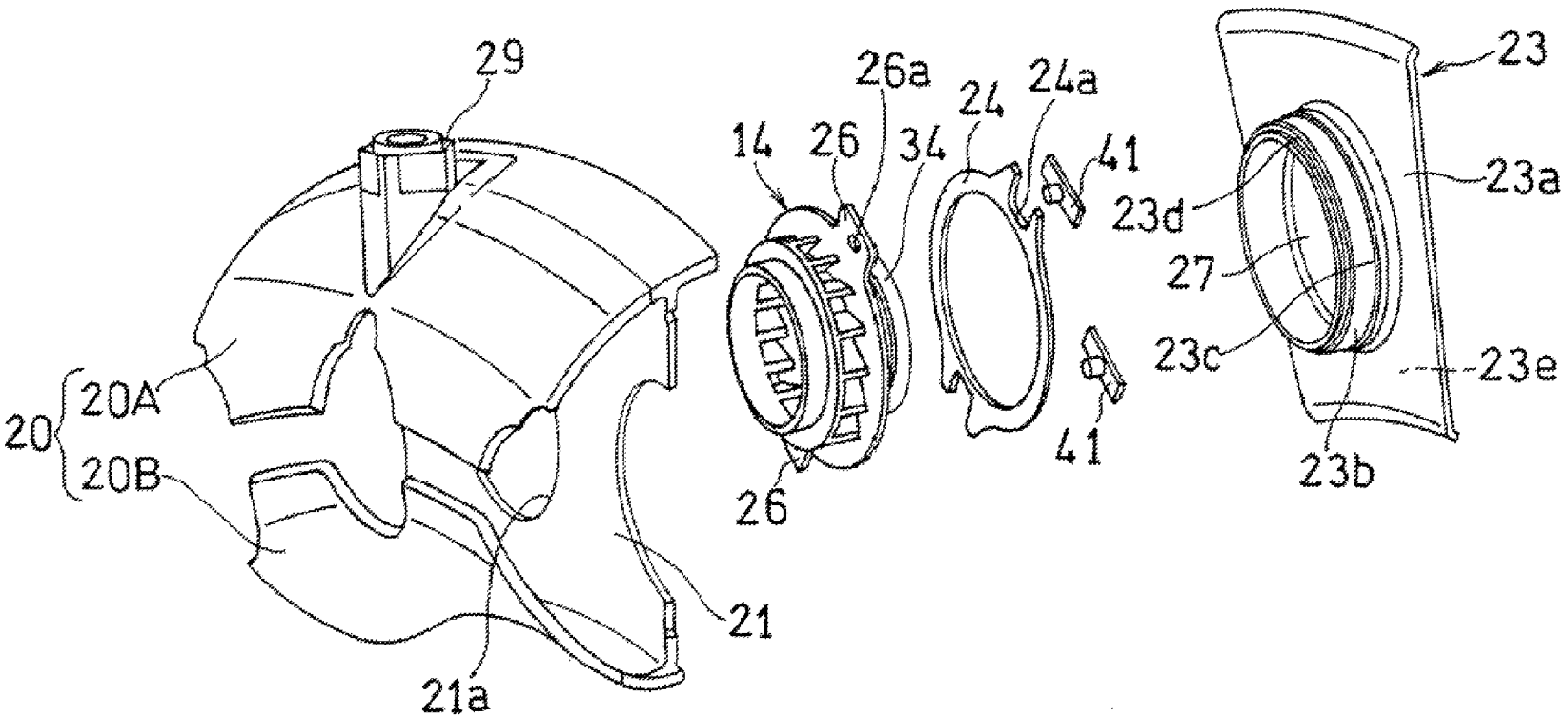
FIG. 4 is an exploded perspective view of the major components of FIG. 2.

As shown in FIG. 4, the heat shield 23 is positioned downstream of the main swirler 14. The heat shield 23 includes a shield body 23*a* of a trapezoidal shape when viewed from a direction of the center axis C2 (FIG. 3) of the fuel injection device 12, and a cylindrical portion 23*b* protruding toward the upstream side of the fuel injection device 12 such that the shield body 23*a* and the cylindrical portion 23*b* have a unitary structure. The inner space of the cylindrical portion 23*b* is a central through-hole 27. The heat shield 23 is placed annularly to have a predetermined gap (e.g., 1 mm). The hole edge portion of the retaining hole 21*a* is welded to the dome 21 and a large-diameter stepped portion 23*c* formed on the outer peripheral surface of the cylindrical portion 23*b* of the heat shield 23. This allows the heat shield 23 to be fastened to the dome 21. The inner peripheral edge portion of the ring-shaped retaining plate 24 is welded to a small-diameter portion 23*d* formed on the opening edge portion of the cylindrical portion 23*b* of the heat shield 23. This allows the retaining plate 24 to be fastened to the heat shield 23.

A tubular guide member 34 is provided integrally with a rear end wall 25 positioned downstream of the main swirler 14. The guide member 34 serves to introduce the swirl flow of the compressed air CA from the main swirler 14 into the combustion chamber 11. The guide member 34 is placed concentrically with the cylindrical portion 23*b* of the heat shield 23 on the inner peripheral side of the cylindrical portion 23*b*. A flare 38 is coupled to the downstream end of the guide member 34 and is inclined from radially outward relative to the fuel injector 13 toward a downstream side. In other words, the flare 38 is configured to have a diameter which increases toward the downstream side. Alternatively, the guide member 34 and the flare 38 may be formed integrally with each other. Since the swirl flow of the compressed air CA from the main swirler 14 is a significant factor for determining a size or position of a back flow zone of the air-fuel mixture M, a combustion zone S (FIG. 2) can be set by adjusting this swirl flow.

The rear end wall 25 of the main swirler 14 includes mounting plates 26 protruding radially outward. The mounting plates 26 are provided in two locations such that the mounting plates 26 face each other. The mounting plates 26 have pin holes 26*a*, respectively. The retaining plate 24 has a pair of recesses 24*a* which open in an outer peripheral portion thereof. Mounting pins 41 are inserted into the recesses 24*a*, respectively. The mounting pins 41 are fitted into and secured to the pin holes 26*a*, respectively. The recess 24*a* of the retaining plate 24 has a circumferential width greater than the outer diameter of the mounting pin 41. Therefore, the main swirler 14 is supported on the retaining plate 24 such that the main swirler 14 is displaceable in the circumferential direction and in the radial direction. This makes it possible to absorb a displacement between the main swirler 14 and the heat shield 23 which occurs due to a difference in thermal expansion rates between the components which is caused by high-temperature combustion gas G, or an assembling process.

An annular space 39 is defined by the rear end wall 25 located downstream of the main swirler 14, the cylindrical portion 23*b* of the heat shield 23, and the guide member 34 located radially inward relative to the cylindrical portion 23*b* of the heat shield 23. The annular space 39 is coaxial with the fuel injection device 12 and opens toward the downstream side. Purge holes 40 are formed in a portion of the cylindrical portion 23*b* which is upstream of a location at which the dome 21 is fastened to the cylindrical portion 23*b*. The plurality of purge holes 40 are formed at circumferentially equal intervals on the circumference of the cylindrical portion 23*b*, and through the purge holes 40, the compressed air CA is introduced from radially outward into the annular space 39. The purge holes 40 penetrate the cylindrical portion 23*b* radially. The compressed air CA introduced into the annular space 39 through the purge holes 40 flows into the combustion chamber 11 through an outlet 39*a* at the downstream end of the annular space 39. The flow of the compressed air CA can push back the fuel F, the air-fuel mixture M, and a flame, which are going to enter the annular space 39, into the combustion chamber 11.

Ten to thirty purge holes 40 are formed at circumferentially equal intervals on the circumference of the cylindrical portion 23*b*. If the purge holes 40 are less than ten in number, it becomes difficult to introduce the compressed air CA into the annular space 39 between the guide member 34 and the heat shield 23, uniformly in the circumferential direction. Therefore, the flow of the compressed air CA cannot effectively push back the fuel F, the air-fuel mixture M, and the flame, which are going to enter the annular space 39, into the combustion chamber 11. If the purge holes 40 are greater than thirty in number, deposition of the soot cannot be prevented effectively, and processing work and costs will increase. Preferably, the purge hole 40 has a diameter of about 1±0.3 mm. The flow rate of the compressed air CA introduced through the purge holes 40 is about 10±5% of the flow rate of the compressed air CA from the main swirler 14. The flow rate of the compressed air CA from the main swirler 14 is preferably reduced by that flow rate. In this case, a total flow rate of the compressed air CA introduced into the combustion chamber 11 is equal to the flow rate in a case where no purge holes 40 are provided. Therefore, preset combustion performance can be maintained.

In accordance with the above configuration, the compressed air CA is introduced through the purge holes 40, into a space in which the soot tends to be deposited in a conventional combustor, specifically, the annular space 39, and can push back the fuel F, the air-fuel mixture M, and flame, which are going to enter the annular space 39, into the combustion chamber 11. This makes it possible to effectively suppress the soot from being deposited on the outer peripheral surface of the guide member 34 of the main swirler 14, and the main swirler 14 from becoming damaged by the heating of the deposited soot.

The flare 38 mainly has two functions. The first function is to serve as a guide section which guides the flow of the compressed air CA, introduced through the purge holes 40, in a radially outward direction (changing the direction of the flow). That is, as shown in FIG. 3, the flare 38 forms a flow passage extending in an obliquely outward direction toward the downstream side, between the outer peripheral surface thereof and the heat shield 23. The flare 38 causes the compressed air CA to flow along this flow passage such that the compressed air CA is guided in the obliquely outward direction toward the downstream side. It is desired that a portion of the heat shield 23 which faces the flare 38 be inclined in a radially outward direction toward the downstream side. In this configuration, resistance in the flow passage can be reduced, and a more stable flow can be supplied to the interior of the combustion chamber 11.

The second function is to adjust the flow of the compressed air CA which has passed through the guide member 34. To be specific, the swirl flow of the compressed air CA which has passed through the guide member 34 flows along the inner peripheral surface of the flare 38. Therefore, by adjusting the inclination angle or the like of the flare 38, the swirl flow of the compressed air CA can be adjusted. As described above, it is very important to adjust the swirl flow of the compressed air CA, in setting the combustion zone S.

Next, a description will be given of the fluidization pattern of the compressed air CA and the dispersion distribution of the air-fuel mixture M in the interior of the combustion chamber 11, with reference to FIG. 5. To enable performance of efficient and stable combustion, ideally, a fuel distribution does not have thickness in the combustion zone S, and the air-fuel mixture M stays in the combustion zone S for a long period of time. In view of this, the conventional gas turbine combustor, and the gas turbine combustor having the purge holes and the flare of the present embodiment will be described respectively.

Figure 5B:
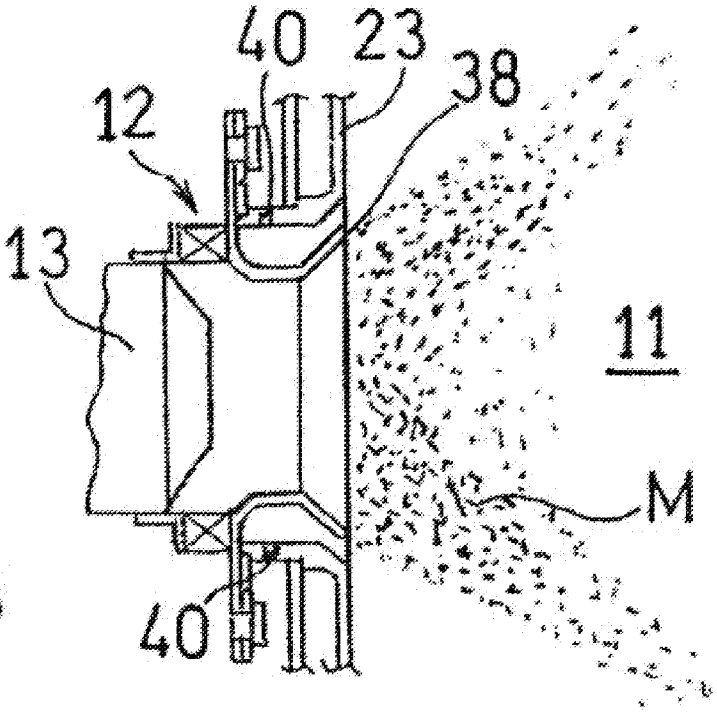
FIGS. 5A and 5B are longitudinal sectional views each showing a fluidization pattern of compressed air and a dispersion distribution of an air-fuel mixture in the interior of a combustion chamber of the above gas turbine combustor.
Figure 5A:
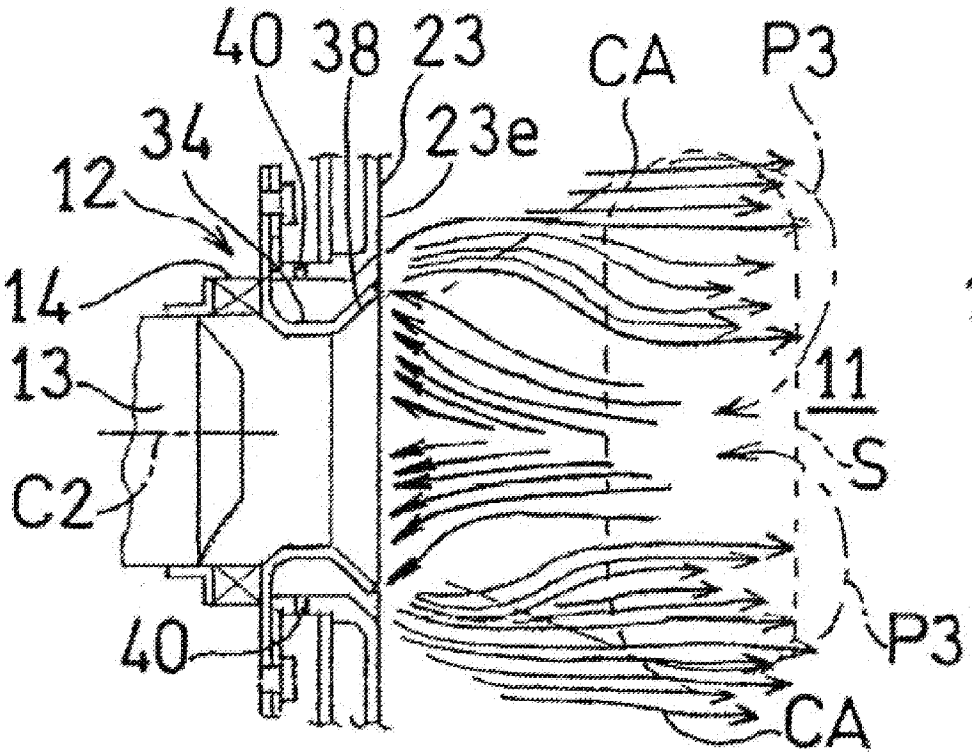
Figure 5D:
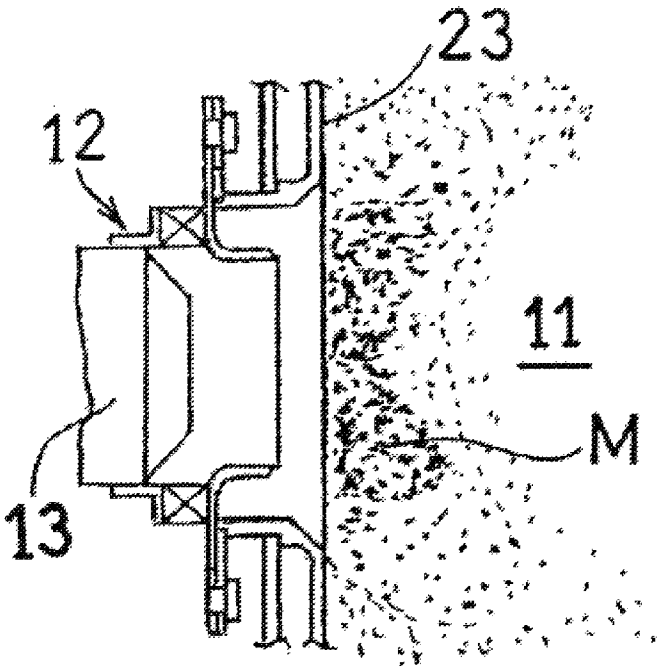
FIGS. 5C and 5D are longitudinal sectional views each showing a fluidization pattern of compressed air and a dispersion distribution of an air-fuel mixture in the interior of a combustion chamber of a conventional combustor in the Comparative example.
Figure 5C:
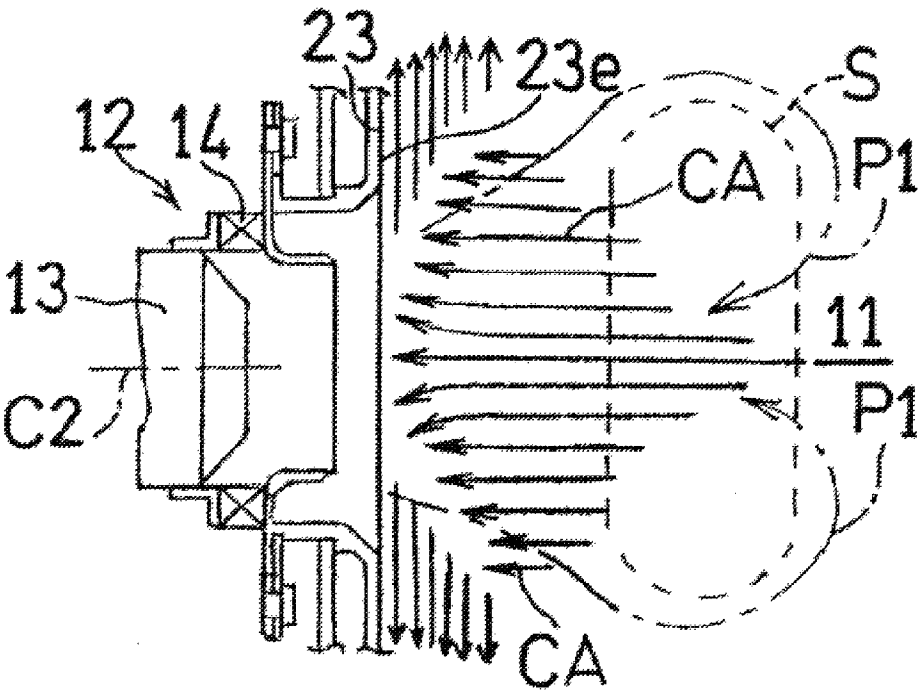

Firstly, in the case of the conventional gas turbine combustor, as shown in FIG. 5C, the compressed air CA supplied from the swirler 14 flows radially outward relative to the fuel injection device 12 in the interior of the combustion chamber 11 along the inner surface 23*e* of the heat shield 23. As a result, pressure decreases over a wide range in the vicinity of the center axis, thereby causing the released compressed air CA to flow at a high speed, toward the wide range in the vicinity of the center axis. That is, as a whole, the compressed air CA forms a circulation flow P1 which flows while expanding radially outward, and then strongly flows back toward the center axis portion of the combustion chamber 11. By the above flow of the compressed air CA, the air-fuel mixture M disperses as shown in FIG. 5D. The air-fuel mixture M supplied from the fuel injector 13 is pushed back by the circulation flow P1, and a large amount of the air-fuel mixture M is present in the vicinity of the fuel injector 13 in the interior of the combustion chamber 11. Therefore, in some cases, it is less likely that an adequate amount of the air-fuel mixture M reaches the combustion zone S. Also, in other cases, the air-fuel mixture M is guided by the compressed air CA to flow along the inner surface 23*e* of the heat shield 23, and the fuel in the air-fuel mixture M adheres onto the inner surface 23*e* of the heat shield 23 and forms liquid droplets. If the fuel adhering onto the inner surface 23*e* of the heat shield 23 is supplied in a state of great liquid droplets to the combustion zone of the combustion chamber 11, the fuel is atomized insufficiently, and thus, high ignition performance and stable combustion performance cannot be achieved.

In the case of the gas turbine combustor 1 of the present embodiment, as shown in FIG. 5A, the compressed air CA which has flowed into the annular space 39 flows along the outer peripheral surface of the flare 38 in the obliquely outward direction toward the downstream side in the interior of the combustion chamber 11 such that the flow of the compressed air CA expands to a suitable degree. The compressed air CA flowing in the obliquely outward direction toward the downstream side wraps the compressed air CA from the main swirler 14 and the air-fuel mixture M, from radially outward, and prevents the compressed air CA from the main swirler 14 and the air-fuel mixture M, from expanding excessively. This results in a circulation flow P3 having a back flow with a proper strength, in the center axis portion of the combustion chamber 11. That is, the air-fuel mixture M is supplied to the combustion zone S at a proper speed, thereby ensuring good flame stabilizing performance. In addition, the compressed air CA introduced through the purge holes flows along the flare 38 in the obliquely outward direction toward the downstream side, and therefore, the fuel in the air-fuel mixture M is less likely to adhere onto the inner surface 23*e* of the heat shield 23. This makes it possible to prevent the liquid droplets of the fuel F in the air-fuel mixture M from increasing in size and combustion performance from degrading.

The inclination angle of the flare 38 with respect to the center axis of the guide member 34 is preferably set to a range of 40 degrees to 60 degrees. If the inclination angle is less than 40 degrees, the swirl flow of the compressed air CA from the main swirler 14 cannot be expanded radially sufficiently when it is supplied to the interior of the combustion chamber 11, which makes it difficult to form a back-flow zone having a sufficient area. On the other hand, if the inclination angle is greater than 60 degrees, the swirl flow of the compressed air CA from the main swirler 14 is separated from the inner surface of the flare 38, which makes it impossible to form a back-flow zone having a desired area. If the inclination angle of the flare 38 is set to 45 degrees, it is possible to form the swirl flow of the compressed air CA, which can achieve highest combustion efficiency. Although description has been given above on the premise that the inclination angle of the inner peripheral surface of the flare 38 is equal to the inclination angle of the outer peripheral surface of the flare 38, they may be made different. For example, if the flare 38 is configured to have a thickness increasing toward the downstream side, the inclination angle of the inner peripheral surface is smaller than the inclination angle of the outer peripheral surface.

As described above, in the gas turbine combustor 1, by introducing the compressed air CA into the annular space 39 through the purge holes 40, it is possible to prevent deposition of the soot and damage by combustion. In addition, the size of the liquid droplets of the fuel F is reduced and combustion performance is improved. Furthermore, by using the flare 38 provided at the downstream end of the guide member 34, the flow of the compressed air CA which has flowed through the main swirler 14 and the dispersion distribution of the fuel F injected from the fuel injector 13 can be controlled in an optimized manner. As a result, higher ignition performance and stable combustion performance can be achieved with a considerably improved level. This can be confirmed based on actual measurement result, as shown in FIG. 6.

Figure 6:
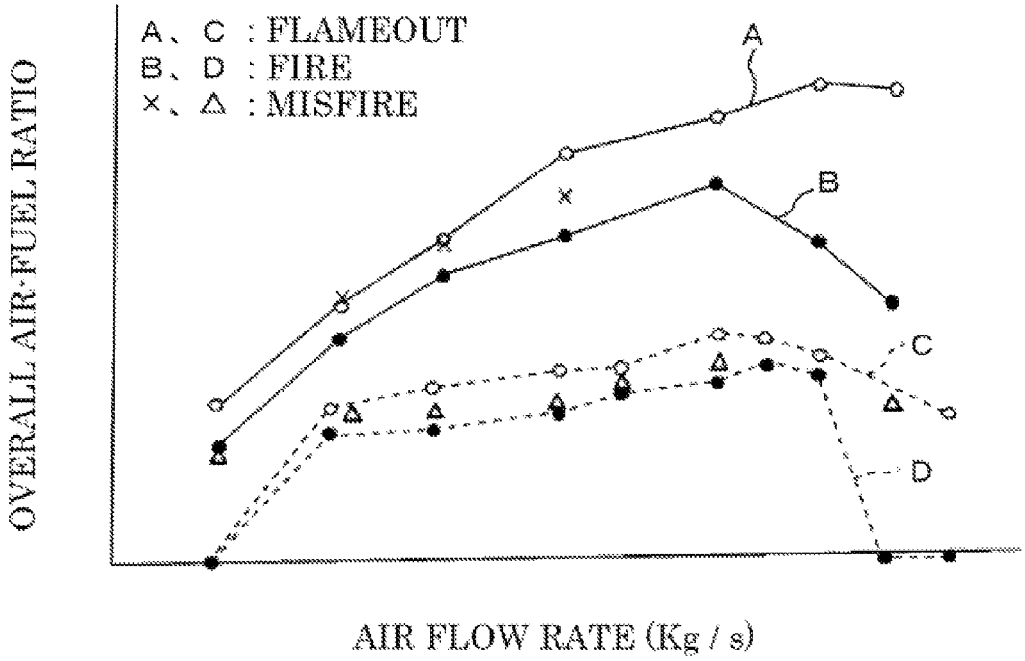
FIG. 6 is a view showing a characteristic of a result of actual measurement of flameout, fire (ignition), and misfire (ignition failure), with respect to an air flow rate and an overall air-fuel ratio.

In FIG. 6, a horizontal axis indicates an air flow rate of the combustor 1, while a vertical axis indicates an air-fuel ratio of the overall combustor 1. White-circle symbols indicate flameout, while black-circle symbols indicate fire (ignition). Characteristic curve lines A and B, represented by solid lines, indicate actual measurement results of the gas turbine combustor 1 of the present invention, while characteristic curve lines C and D, represented by dashed lines, indicate measurement results of the conventional gas turbine combustor. X symbols indicate misfire (ignition failure) of the gas turbine combustor 1 of the present invention, while triangle symbols indicate misfire (ignition failure) of the conventional gas turbine combustor.

As can be clearly seen from a comparison between the characteristic curve lines A and C, the air-fuel ratio with which the flame blows out is much higher in the gas turbine combustor 1 of the present invention, than in the conventional gas turbine combustor. As can be clearly seen from a comparison between the characteristic curve lines B and D, the air-fuel ratio with which the air-fuel mixture M can be ignited is much higher in the gas turbine combustor 1 of the present invention, than in the conventional gas turbine combustor. As can be clearly seen from a comparison between X symbols and triangle symbols, the air-fuel ratio with which misfire occurs is much higher in the gas turbine combustor 1 of the present invention than in the conventional gas turbine combustor. As should be appreciated, the gas turbine combustor 1 of the present invention can ignite the air-fuel mixture M surely with a higher air-fuel ratio, i.e., with a lesser amount of fuel F. In addition, in the gas turbine combustor 1 of the present invention, flameout and misfire are less likely to occur even when the air-fuel ratio is high.

As should be appreciated from the above, the gas turbine combustor 1 of the present invention can perform combustion stably with a high air-fuel ratio, and improve combustion efficiency. Therefore, the amount of generated $CO_2$ can be reduced.

Figure 7:
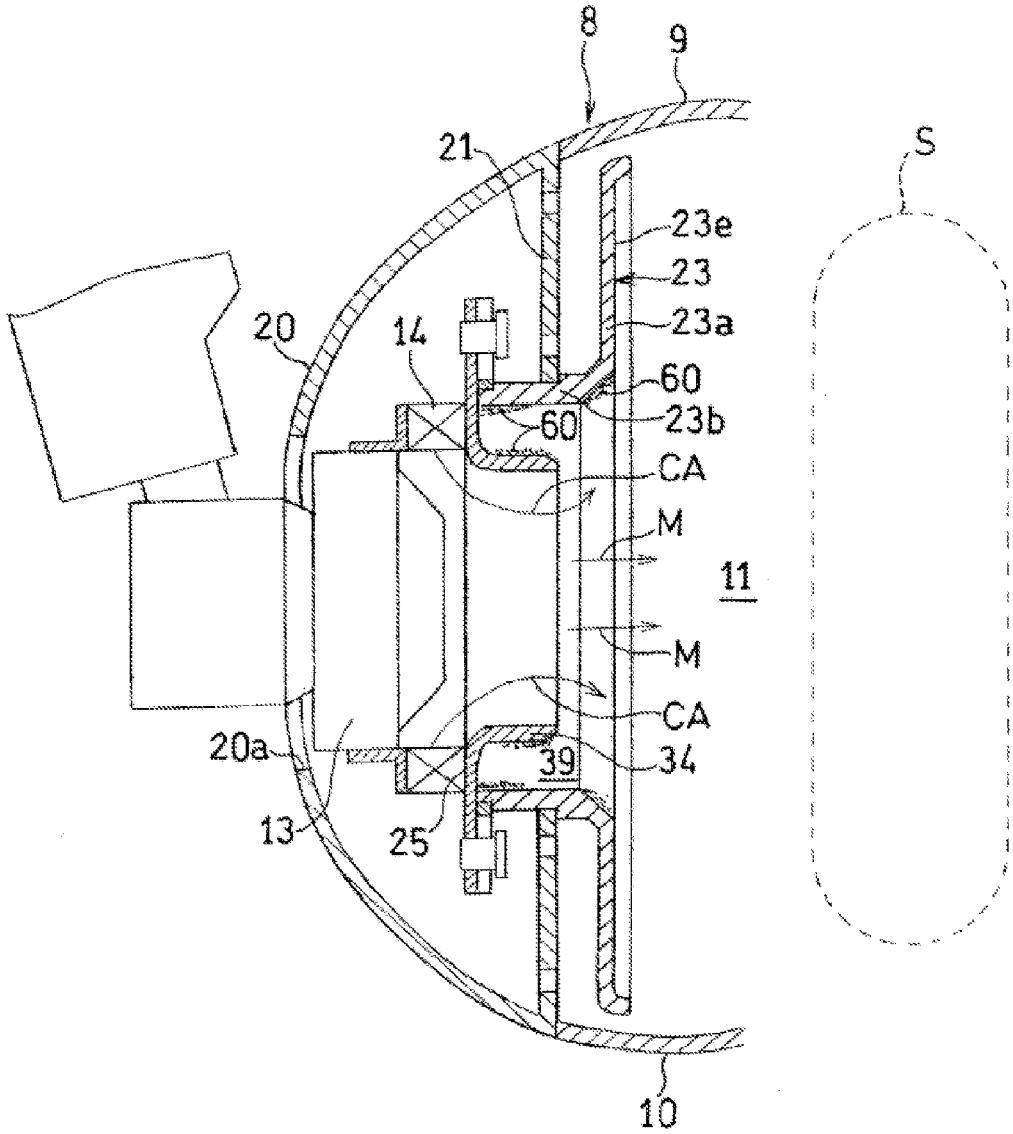
PRIOR ART Fig. 7
FIG. 7 is a longitudinal sectional view showing major components of a conventional gas turbine combustor.

In addition, through an experiment, it was confirmed that the gas turbine combustor 1 of the present invention is equivalent to the conventional combustor of FIG. 7, regarding pressure loss in the interior of the combustor 1, temperature distribution at an outlet of the combustion tube 8, combustion efficiency, the amount of smoke, and the amount of emissions of $NO_x$.

Moreover, as can be clearly seen from a comparison between FIG. 2 and FIG. 7 in which the same or corresponding components are identified by the same reference symbols, the gas turbine combustor 1 of the present invention can be implemented merely by providing the purge holes 40 and the flare 38 at the downstream end of the guide member 34, in the conventional combustor.

Although in the present embodiment, the annular type combustor is shown, the present invention is also applicable to a combustor of a back flow can type. The present invention is not limited to the above embodiment, but can be added, changed or deleted in various ways within a scope of the present invention. Such addition, change and deletion can be included in the scope of the present invention.

REFERENCE SIGNS LIST

1 gas turbine combustor
8 combustion tube
9 outer liner
10 inner liner
11 combustion chamber
12 fuel injection device
13 fuel injector
14 main swirler (swirler)
20 cowling
20*a* opening
21 dome (support member)
23 heat shield
23*b* cylindrical portion
34 guide member
38 flare
39 annular space
40 purge hole
CA compressed air
C2 center axis of fuel injection device
F fuel
G combustion gas
M air-fuel mixture
TN turbine

The invention claimed is:

1. A gas turbine combustor comprising:

a support member disposed to form a boundary between an interior space of a cowling and an interior space of a combustion tube;

a fuel injector for injecting a fuel toward a combustion chamber, which is the interior space of the combustion tube;

a swirler which takes in compressed air generated in a compressor and swirls the compressed air in a vicinity of the fuel injector;

a tubular guide member for guiding the compressed air taken in from the swirler and an air-fuel mixture of the fuel injected from the fuel injector to the combustion chamber;

a heat shield having a cylindrical portion located outward relative to the guide member; and a rear end wall extending radially outward from an upstream end portion of the guide member;

wherein the cylindrical portion is fastened to the support member and has a purge hole which is upstream of a location at which the support member is fastened to the cylindrical portion;

a first opening of the purge hole faces the interior space of the cowling;

a second opening of the purge hole faces an annular space which is communicated with the interior space of the combustion tube and formed by the guide member, the cylindrical portion, and the rear end wall; and air is introduced from the interior space of the cowling through the purge hole and is supplied to the annular space; and a portion which is located at a boundary between the guide member and the rear end wall and faces the annular space has a circular-arc cross-section;

the gas turbine combustor further comprising:

a guide section for guiding the air introduced through the purge hole to a region in an obliquely outward direction toward a downstream side;

wherein a radial distance between the cylindrical portion and the guide member is greater than a radial distance between the cylindrical portion and the guide section.

2. The gas turbine combustor according to claim 1, wherein the guide section is a flare provided at a downstream end of the guide member and having a diameter increasing toward the downstream side.

3. The gas turbine combustor according to claim 1, wherein the air introduced through the purge hole is the compressed air generated in the compressor.

4. The gas turbine combustor according to claim 1, wherein the purge hole is one of 10 to 30 purge holes formed on a circumference of the cylindrical portion.

5. The gas turbine combustor according to claim 2, wherein the flare is inclined 40 to 60 degrees with respect to a center axis of the guide member.

* * * * *